US011779089B2

(12) United States Patent
Ma

(10) Patent No.: US 11,779,089 B2
(45) Date of Patent: Oct. 10, 2023

(54) SHADE STRUCTURE ASSEMBLIES AND COMPONENTS

(71) Applicant: Zhun-an Ma, Ningbo (CN)

(72) Inventor: Zhun-an Ma, Ningbo (CN)

( * ) Notice: Subject to any disclaimer, the term of this patent is extended or adjusted under 35 U.S.C. 154(b) by 121 days.

(21) Appl. No.: 17/249,877

(22) Filed: Mar. 17, 2021

(65) Prior Publication Data

US 2021/0298435 A1 Sep. 30, 2021

Related U.S. Application Data

(60) Provisional application No. 63/002,114, filed on Mar. 30, 2020.

(51) Int. Cl.
*A45B 17/00* (2006.01)

(52) U.S. Cl.
CPC ..... *A45B 17/00* (2013.01); *A45B 2017/005* (2013.01)

(58) Field of Classification Search
CPC ..... A45B 17/00; A45B 2017/005
See application file for complete search history.

(56) References Cited

U.S. PATENT DOCUMENTS

| | | | |
|---|---|---|---|
| 2,475,406 | A | 7/1949 | Russell |
| 3,145,720 | A | 8/1964 | Torii |
| 4,586,525 | A | 5/1986 | Glatz et al. |
| 4,622,987 | A | 11/1986 | Redl et al. |
| 4,674,523 | A | 6/1987 | Glatz |
| 4,878,509 | A | 11/1989 | Tung |
| 5,002,081 | A | 3/1991 | Stromeyer |
| 5,029,596 | A | 7/1991 | Tung |
| 5,349,975 | A | 9/1994 | Valdner |
| 5,584,564 | A | 12/1996 | Phyle |
| 5,785,069 | A | 7/1998 | Glatz |

(Continued)

FOREIGN PATENT DOCUMENTS

| | | |
|---|---|---|
| CN | 2054635 | 3/1990 |
| CN | 2472559 | 1/2002 |

(Continued)

OTHER PUBLICATIONS

Activa 2017 Product Catalog in 92 pages.

(Continued)

*Primary Examiner* — Noah Chandler Hawk
(74) *Attorney, Agent, or Firm* — Knobbe, Martens, Olson & Bear, LLP

(57) ABSTRACT

An umbrella is provided that includes a canopy, a pole and a rotation assembly is provided. The pole extends along a longitudinal axis and has a rotatable portion coupled with the canopy and a lower portion to which the rotatable portion is rotatably coupled at a connection location. A lower end of the rotatable portion is disposed within an upper end of the lower portion. A rotation assembly configured to rotate the rotatable portion of the pole is provided. The rotation assembly has a hand grip and a drive ring disposed around the rotatable portion of the pole. The hand grip applies torque to the drive ring and thereby to the rotatable portion of the pole. The hand grip and the drive ring are configured to move along the longitudinal axis of the pole to disengage a locking assembly to permit rotation of the rotatable portion of the pole relative to the lower portion of the pole.

20 Claims, 6 Drawing Sheets

(56) References Cited

U.S. PATENT DOCUMENTS

| | | | | |
|---|---|---|---|---|
| D398,443 | S | 9/1998 | Bolle | |
| 5,868,152 | A | 2/1999 | Brown | |
| 5,937,882 | A | 8/1999 | Harbaugh | |
| 6,014,980 | A | 1/2000 | Glatz | |
| 6,152,156 | A | 11/2000 | Tung | |
| 6,220,261 | B1 | 4/2001 | Glatz | |
| 6,311,705 | B1 | 11/2001 | Ma | |
| 6,330,886 | B1 | 12/2001 | Culver | |
| 6,478,037 | B2 | 11/2002 | Tung | |
| 6,575,182 | B2 | 6/2003 | Tung | |
| 6,575,183 | B2 | 6/2003 | Tung | |
| 6,588,438 | B1 | 7/2003 | Steiner | |
| 6,619,306 | B2 | 9/2003 | Ma | |
| 6,662,815 | B2 | 12/2003 | Tung | |
| 6,837,255 | B2 | 1/2005 | Bunch et al. | |
| 6,851,823 | B2 | 2/2005 | Bilotti | |
| 7,412,985 | B2 | 8/2008 | Ma | |
| 8,402,981 | B2 | 3/2013 | Liu | |
| 8,763,620 | B1 | 7/2014 | Tung | |
| 9,615,637 | B1 | 4/2017 | Tung | |
| 11,116,296 | B1 * | 9/2021 | Xie | A45B 25/08 |
| 2003/0062073 | A1 * | 4/2003 | Tung | A45B 25/14 135/42 |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/1822429 | | 9/2004 | Chen | |
| 2005/0268953 | A1 * | 12/2005 | Ma | A45B 17/00 135/20.3 |
| 2023/0047818 | A1 | 2/2023 | Ma | |

FOREIGN PATENT DOCUMENTS

| | | |
|---|---|---|
| CN | 2494144 | 6/2002 |
| CN | 2512299 | 9/2002 |
| CN | 2579212 | 10/2003 |
| CN | 2629510 | 8/2004 |
| DE | 20 2010 013 970 | 4/2011 |
| EP | 3 888 484 | 10/2021 |
| WO | WO 2006/000136 | 1/2006 |

OTHER PUBLICATIONS

Operation Manual Easy Sun Parasol Sunshade (Issue: Jul. 2004) pp. 1-17.

Sunvilla Corporation, Assembly Instructions, 3m /10ft Market Umbrella with 56 LED Light.

* cited by examiner

SHADE STRUCTURE ASSEMBLIES AND COMPONENTS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application is directed to shade structures, assemblies, and components, including umbrella assemblies and components.

Description of the Related Art

Umbrellas can have multiple open configurations. One type of umbrella is supported at its center and from below by a pole and can be placed into a tilted configuration in which a canopy assembly coupled with a top portion of the pole can be placed at an angle to a central pole portion therebelow. Such umbrella can be rotated by a mechanism that rotates the central pole portion relative to a lower pole portion. FIG. 1 shows such an umbrella in which a mechanism for rotating the central portion is disposed outside the pole, i.e., between a rotation handle and an outer surface of the pole.

SUMMARY OF THE INVENTION

It is desired to provide shade structures and components therefor that can enhance performance of a rotation mechanism. For example, a rotation mechanism can be mounted inside the umbrella pole. The rotation mechanism can include a handle that can be displaced along the pole. The handle can be rotated about a longitudinal axis of the central and/or lower portion of the pole. The top portion of the pole can, in some cases, be angled relative to the longitudinal axis.

In one embodiment, an umbrella is provided that includes a canopy, a pole, and a rotation and locking assembly. The pole can be configured as an assembly of more than one pole portion. The pole can extend along a longitudinal axis. The pole can have an upper portion coupled with the canopy and a lower portion rotatably coupled with the upper portion. A rotation and locking assembly can be provided that can be configured to rotate the upper portion of the pole. The rotation and locking assembly can have a shaft, a first locking member, and a second locking member. The shaft can have a lower end fixed to the lower portion of the pole and an upper end disposed in a portion of the pole above the lower portion, e.g., in an upper or a central portion. The first locking member can be disposed above the lower portion of the pole. The first locking member can be coupled with the upper end of the shaft. The second locking member can be disposed above the lower portion of the pole adjacent to the first locking member. The second locking member can be configured to engage the first locking member. The rotation and locking assembly can include a hand grip disposed around a portion of the pole above the lower portion and can be engaged with the second locking member. The hand grip can have a first position along the longitudinal axis of the pole in which the second locking member is engaged with the first locking member. The hand grip can have a second position along the longitudinal axis of the pole spaced apart from the first position in which the second locking member is disengaged from the first locking member.

In one embodiment, the rotation and locking assembly is configured to directly rotate the upper pole portion. In one embodiment, the rotation and locking assembly is configured to rotate a central pole portion, which can be a pole portion that is between an upper and a lower pole portion.

In some embodiments, one or both of the first locking member and the second locking member are disposed within the pole or pole assembly.

In some embodiments, a drive ring is disposed around a rotatable portion of the pole assembly. The drive ring can be moveable along the longitudinal axis of the pole by movement of the hand grip.

In some embodiments, the drive ring further comprises a plurality of splines aligned with the longitudinal axis of the pole. The hand grip also can have an outer surface, an inner surface, and a plurality of radial projections being disposed on the inner surface. The radial projections are configured to engage the plurality of splines. In some cases, the pole comprises a slot and further comprising a shaft coupled with the hand grip, the shaft disposed through the drive ring and the slot of the pole, wherein an inner portion of the shaft is coupled with the second locking member.

In some embodiments, the first locking member has a central recess disposed around the upper end of the shaft and an outer surface comprising a plurality of splines disposed thereon. The first locking member comprises a tapered lower end. The second locking member can have a central passage disposed around the shaft. The second locking member can have an upper recess comprising a plurality of splines disposed on an inner surface thereof.

In some embodiments, a thrust bearing has a first portion disposed within the lower portion of the pole and a second portion fixedly coupled with a lower end of a rotatable portion of the pole or pole assembly. The first portion can be disposed on an upper surface of a plug member. The second portion can be rotatable relative to the first portion. The second portion of the thrust bearing can be partly inserted into the lower end of the rotatable pole portion. The second portion can have a projection received in a recess of the lower end of the upper portion or central portion of the pole or pole assembly to transmit a torque from the upper or central portion of the pole or pole assembly and the second portion of the thrust bearing.

In some embodiments, a spring (sometimes called spring member herein) or other resilient member is disposed between the second locking member and a structure that is not translatable along the longitudinal axis of the pole. The spring member can be configured to bias the second locking member to a locking first position. The spring member can be configured to bias the hand grip to a locking position.

In another embodiment, an umbrella is provided that includes a canopy, a pole, and a rotation assembly. The pole extends along a longitudinal axis and has an upper portion coupled with the canopy. The upper portion is rotatably coupled, directly or indirectly, with a lower portion of the pole. A connection location between the rotatable portion of the pole and the lower portion can be disposed within an upper end of the lower portion. The rotation assembly can be configured to rotate the upper portion of the pole. The rotation assembly can have a hand grip and a drive ring disposed around the rotatable portion of the pole. The hand grip can apply a torque to the drive ring and thereby to the rotatable portion of the pole. A locking assembly has a first locking member and a second locking member disengageable from the first locking member. The first locking member and the second locking member can be disposed above the connection location.

In another embodiment, an umbrella is provided that includes a canopy, a pole and a rotation assembly. The pole extends along a longitudinal axis and has a rotatable portion coupled with the canopy and a lower portion to which the rotatable portion is rotatably coupled at a connection location. A lower end of the rotatable portion is disposed within an upper end of the lower portion. A rotation assembly configured to rotate the rotatable portion of the pole is provided. The rotation assembly has a hand grip and a drive ring disposed around the rotatable portion of the pole. The hand grip applies torque to the drive ring and thereby to the rotatable portion of the pole. The hand grip and the drive ring are configured to move along the longitudinal axis of the pole to disengage a locking assembly to permit rotation of the rotatable portion of the pole relative to the lower portion of the pole.

BRIEF DESCRIPTION OF THE DRAWINGS

Features of the invention can be better understood from the following detailed description when read in conjunction with the accompanying schematic drawings, which are for illustrative purposes only. The drawings include the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

This application discloses an inventive umbrella assembly that allows a upper pole portion thereof to rotate relative to a lower pole portion.

Figure 1:
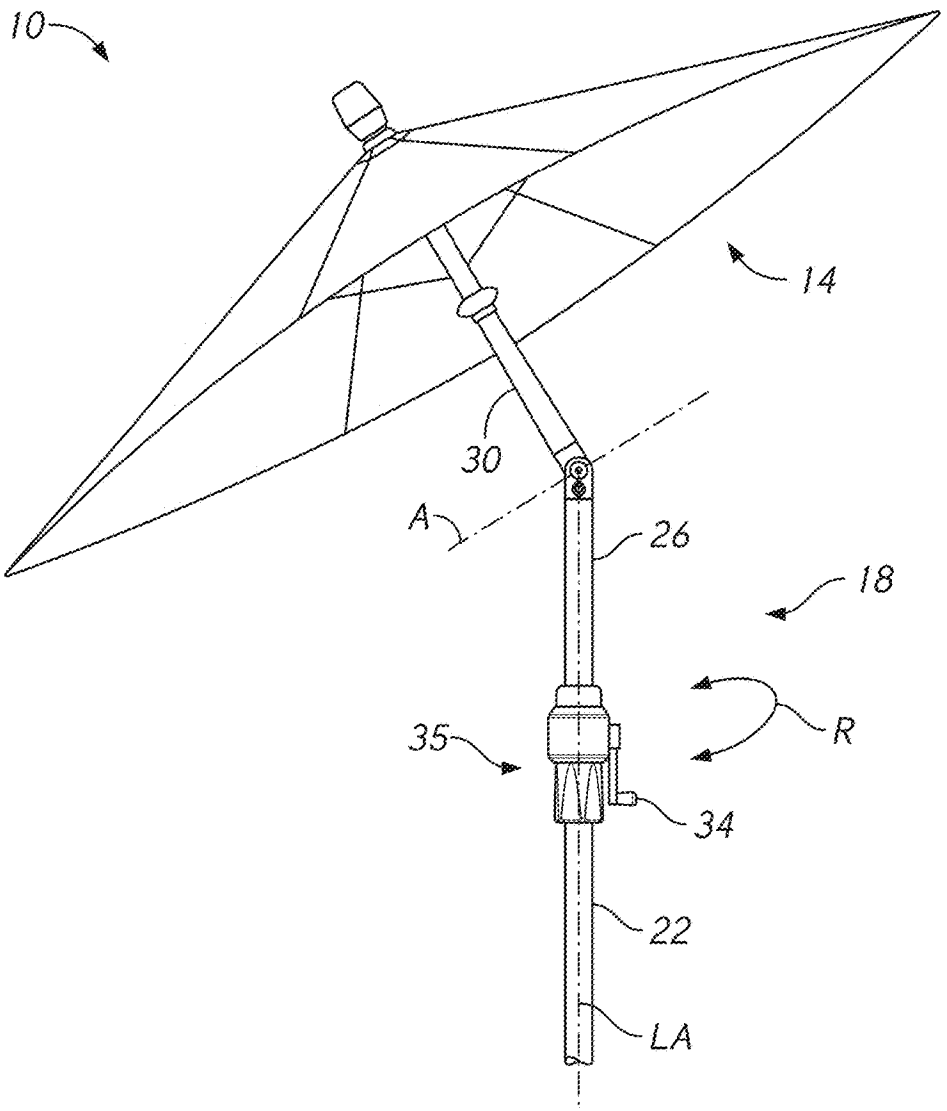
FIG. 1 is an example of a market umbrella that can be tilted to allow shade provided by the umbrella to be moved when the sun is not directly overhead.

FIG. 1 shows an umbrella 10 that can incorporate various control configurations disclosed herein. The umbrella 10 includes a canopy assembly 14 and a pole assembly 18. The pole assembly 18 includes a lower portion 22, a central portion 26, and an upper portion 30. The upper portion 30 can pivot about a tilt axis A. The tilt axis A is disposed transverse to the longitudinal axis LA of the lower portion 22 and the central portion 26 of the pole assembly 18. Also, the umbrella 10 can be opened and closed by operating a crank assembly 34. The crank assembly 34 can rotate in one direction to tension a cord acting on a lower hub of the canopy assembly 14 to raise the lower hub. As the lower hub is raised, a rib assembly of the canopy assembly 14 can be actuated to tension a canopy fabric on the canopy assembly 14. The umbrella 10 also includes a rotation handle 38 that can be operated to rotate the central portion 26 and the upper portion 30 relative to the lower portion 22. The rotation of the rotation handle 38 causes the shade cast by the canopy assembly 14 to be moved to a more appropriate location given the position of the sun in the sky and/or the location to be shaded. The rotation handle 38 allows for rotation about a rotation axis as indicated by R. The rotation R can be up to 360 degrees or more from any position or orientation.

Figure 2:
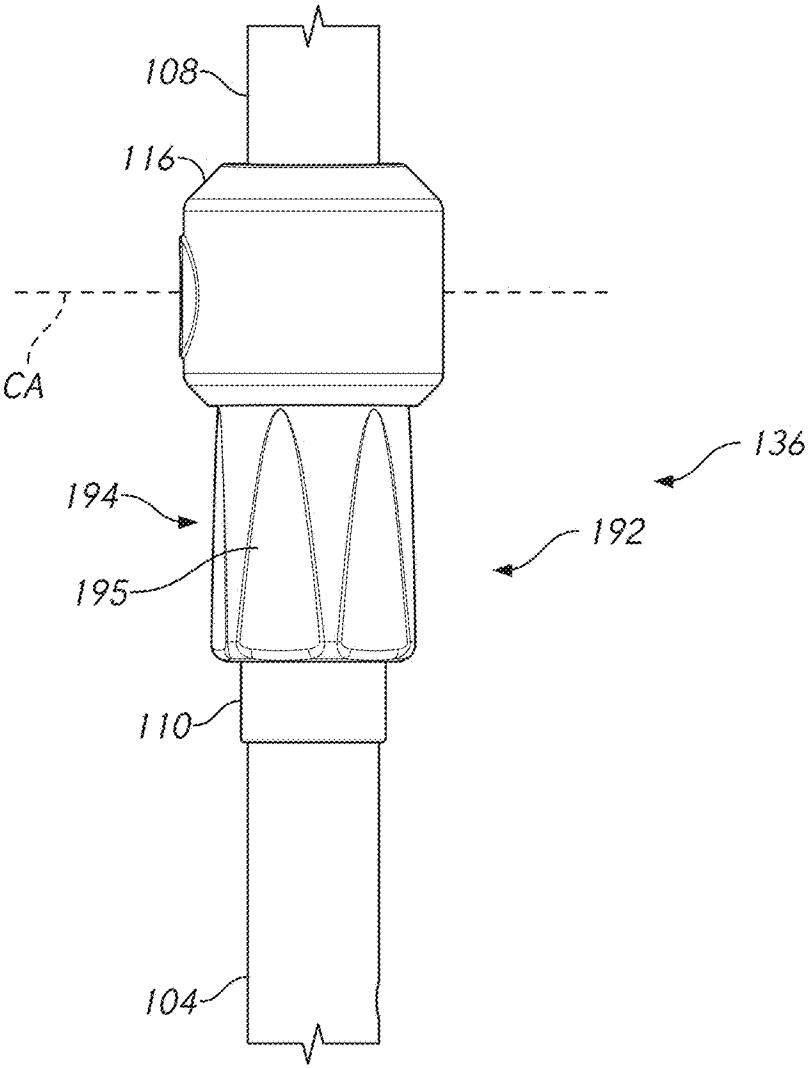
FIG. 2 is a side view of a rotation and locking assembly and an open and closing mechanism for an improvement of the umbrella of FIG. 1.
Figure 5:
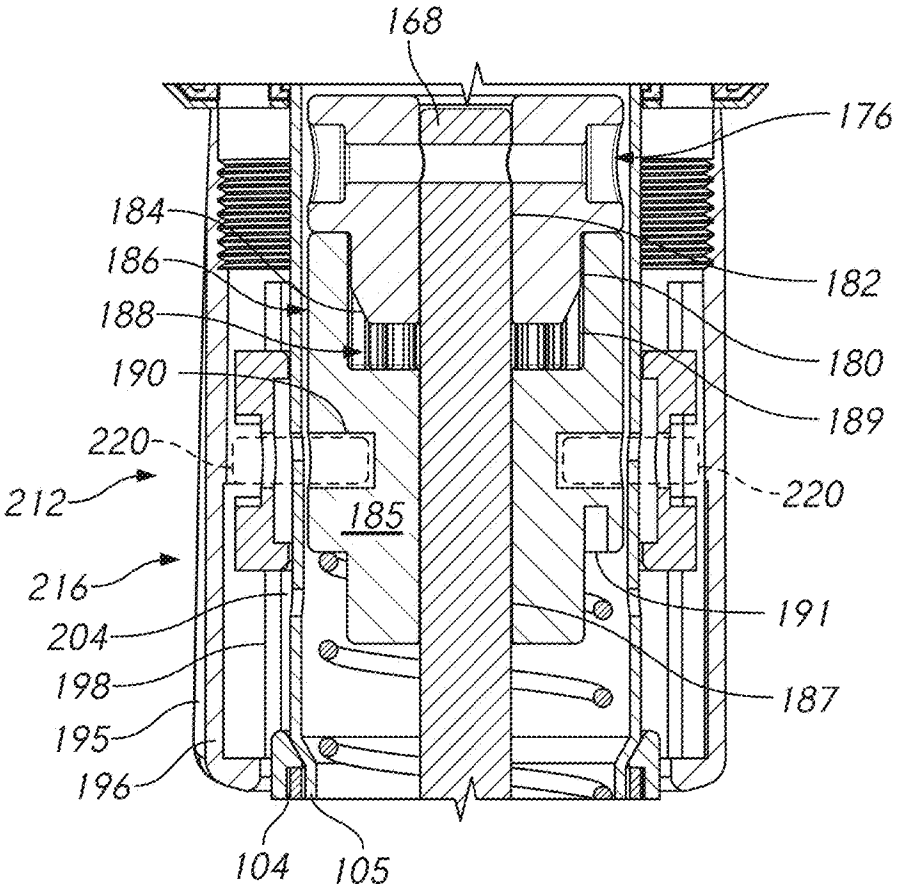
FIG. 5 is detail view of a portion of the cross-section of FIG. 4 showing a first locking member and a second locking member thereof.
Figure 6:
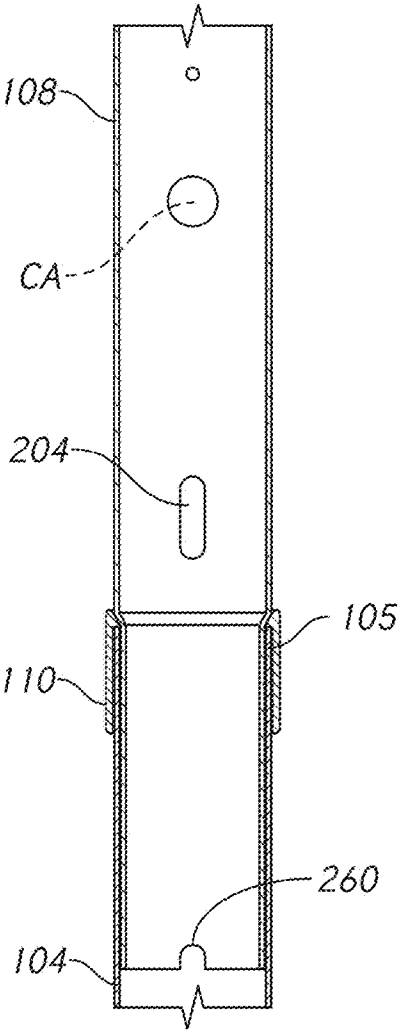
FIG. 6 shows a pole assembly in a vertical cross-section taken along the central longitudinal axis of the pole assembly.
Figure 9:
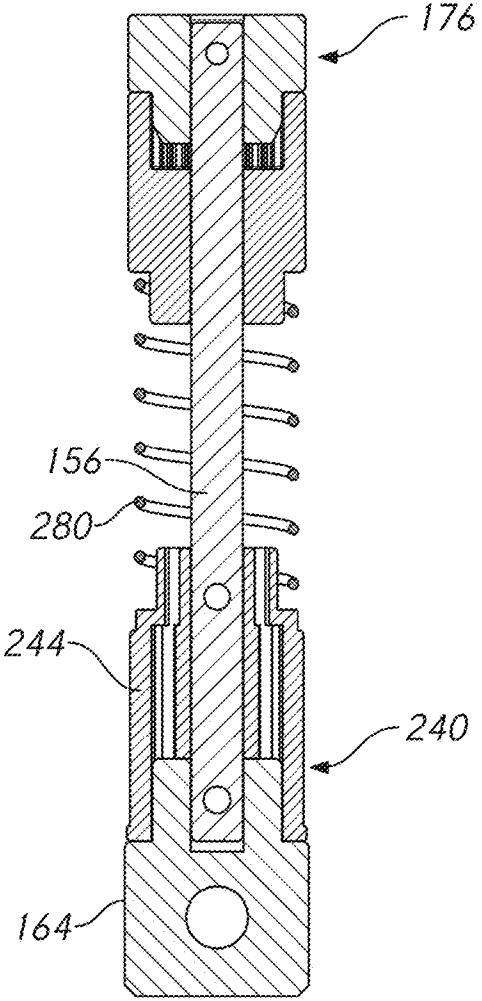
FIG. 9 is a cross-sectional view of the portion of the rotation and locking assembly shown in FIG. 7.
Figure 8:
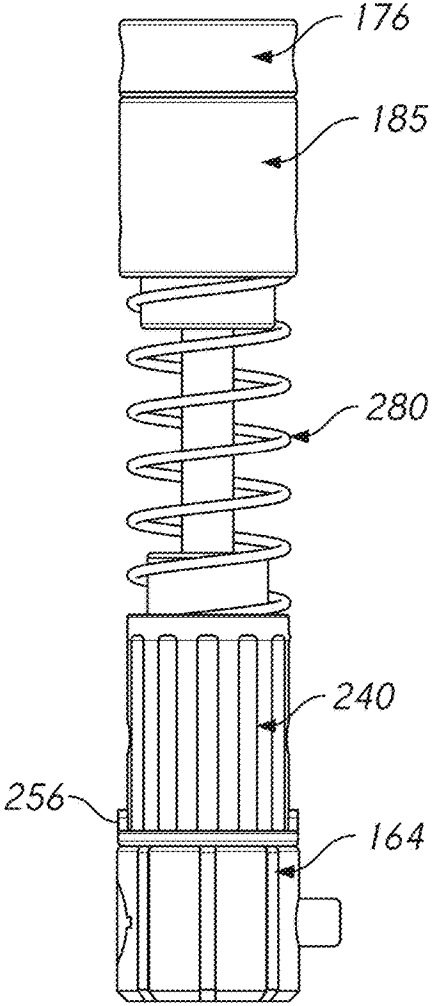
FIG. 8 is a side view of the portion of the rotation and locking assembly shown in FIG. 7.
Figure 10:
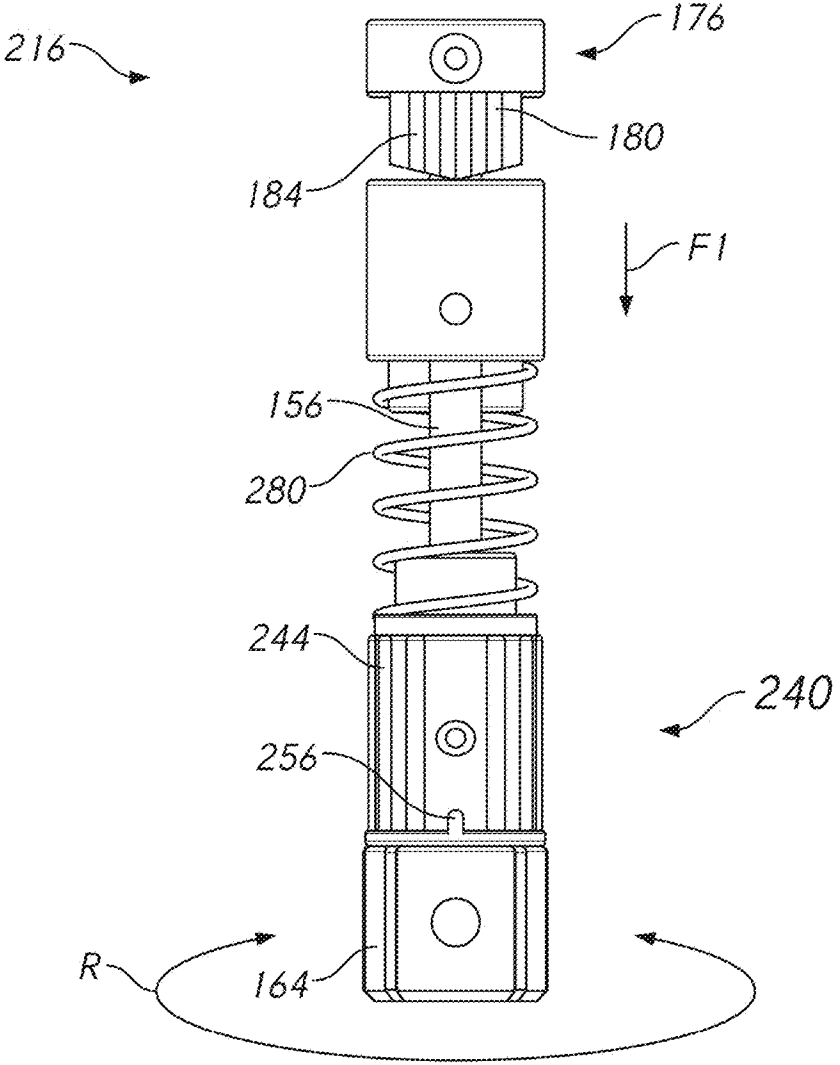
FIG. 10 is a side view similar to FIG. 8 showing the portion of the rotation and locking assembly in a second position corresponding to a configuration of the improved umbrella allowing the upper pole portion thereof to rotate.

FIGS. 2-10 show additional details of features of improvements of the umbrella 10. FIG. 2 shows a pole assembly 100 and a rotation and locking assembly 136. The rotation and locking assembly 136 can be used in connection with the rotation handle 38. Other features of the umbrella 10 can be combined with the features of FIGS. 2-10 to provide various improvements. The pole assembly 100 can be further understood in view of the umbrella 10 and FIG. 6. FIG. 6 shows that the pole assembly 100 can include a lower pole portion 104 and a central pole portion 108. The lower pole portion 104 can be cylindrical and can extend from a lower end to an upper end 105. The pole assembly 100 can also include a sleeve 110 that is disposed over the upper end 105 and that extend for a distance to a lower end of the sleeve 110 that is below the upper end 105 of the lower pole portion 104. The sleeve 110 can include a radial projection at the upper end thereof such that the sleeve 110 rests on the top surface of the upper end 105 of the lower pole portion 104. The central pole portion 108 can include a first cylindrical structure in an upper length thereof and a second cylindrical structure in a lower length thereof. The second cylindrical section can have a smaller inner and a smaller outer diameter. The transition from the first cylindrical section to the second cylindrical section can rest atop the radial projection of the sleeve 110. The interface between the transition from the first cylindrical section to the second cylindrical section can be moveable in rotation over the radial projection of the sleeve 110 as described further below.

The pole assembly 100 can have a first aperture through which a crank axis CA extends. The crank axis CA can be axis about which the crank assembly 34 rotates in opening and closing the canopy assembly 14. The pole assembly 100 can include an elongate slot 204 that provides for movement of the rotation and locking assembly between a first position and a second position. The first position is one in which rotation of the central pole portion 108 relative to the lower pole portion 104 is prevented. The second position 216 is one in which such relative rotation is permitted. The pole assembly 100 can also include a notch 260 that can facilitate integration of the lower end of the central pole portion 108 with a thrust bearing, as discussed further below.

A housing 116 can be provided to house some aspects of the crank assembly 34. The rotation and locking assembly 136 can be coupled with the pole assembly 100. FIG. 2 shows that the rotation and locking assembly 136 can include a hand grip assembly 192 that is disposed above the pole assembly 100, e.g., disposed about the central pole portion 108. In a first position 212 (illustrated in FIGS. 2-5) the hand grip assembly 192 is disposed immediately adjacent to, e.g., just below or slightly overlapping with a lower end of the housing 116. The hand grip assembly 192 can include a hand grip 194, which is a portion of the rotation and locking assembly 136 that a user can grasp by hand to actuate the rotation and locking assembly 136 as discussed further below, by gripping the external surface 195 thereof. The external surface 195 can be faceted, as shown, to make gripping easier for a wide range of user, including individuals with less strength or smaller hands.

Figure 3:
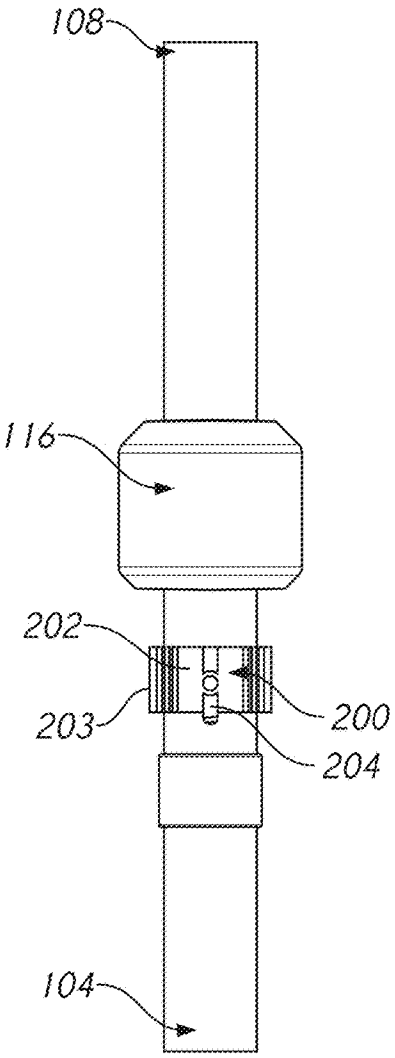
FIG. 3 is side view similar to FIG. 2 with a hand grip removed to show internal structures of a hand grip assembly according to one embodiment.

FIG. 3 shows that within the hand grip 194 a drive ring 200 can be provided. The drive ring 200 can be configured as a sliding sleeve. The hand grip 194 and the drive ring 200 can be configured to mate to transfer a torque applied to the external surface 195 to the drive ring 200 and from the drive ring 200 to an internal locking and rotation device. FIGS. 3 and 5 can be integrated by engagement of structures on an internal surface 196 of the hand grip 194 and on an external surface 202 of the drive ring 200. The internal surface 196 can include one or a plurality of radial projections 198, e.g., splines, projecting inwardly toward the drive ring 200. The radial projections 198 can be located at regular intervals about the internal surface 196. The radial projections 198 can be disposed at 45 degree spacing from each other. The drive ring 200 can have one or a plurality of radial projections 203, e.g., external splines, disposed on the external surface 202. The radial projections 203 circumferentially overlay with the radial projections 198 on the hand grip 194. Circumferential overlap can include the radially outermost ends of the radial projections 203 being radially outward of radially innermost ends of the radial projections 198. As the hand grip 194 is rotated relative to the drive ring 200 the radial projections 198 come into contact with the radial projections 203 allowing a torque to be applied through the projections to the drive ring 200. The torques can be further transferred into the rotation and locking assembly 136 to facilitate rotation of the central pole portion 108 relative to the lower pole portion 104 of the pole assembly 100.

FIG. 3 illustrates how motion of the drive ring 200 relative to the pole assembly 100 can be provided. The drive ring 200 can have a shaft 220 (see FIG. 5) joining the drive ring 200 with internal structures of the rotation and locking assembly 136. The shaft 220 can be allowed to move relative to the pole assembly 100 by the oval slot 204. The shaft 220 extends through the shaft 220 and into or through the thickness of the drive ring 200. The shaft 220 can move along the slot 204 to an upper position (as shown in FIG. 3) corresponding to a first position 212 of the rotation and locking assembly 136. The first position 212 corresponds to a rotation preventing configuration of the rotation and locking assembly 136. The shaft 220 can move along the slot 204 to a lower position corresponding to a second position 216 of the rotation and locking assembly 136. The second position 216 corresponds to a rotation allowing configuration of the rotation and locking assembly 136.

Figure 4:
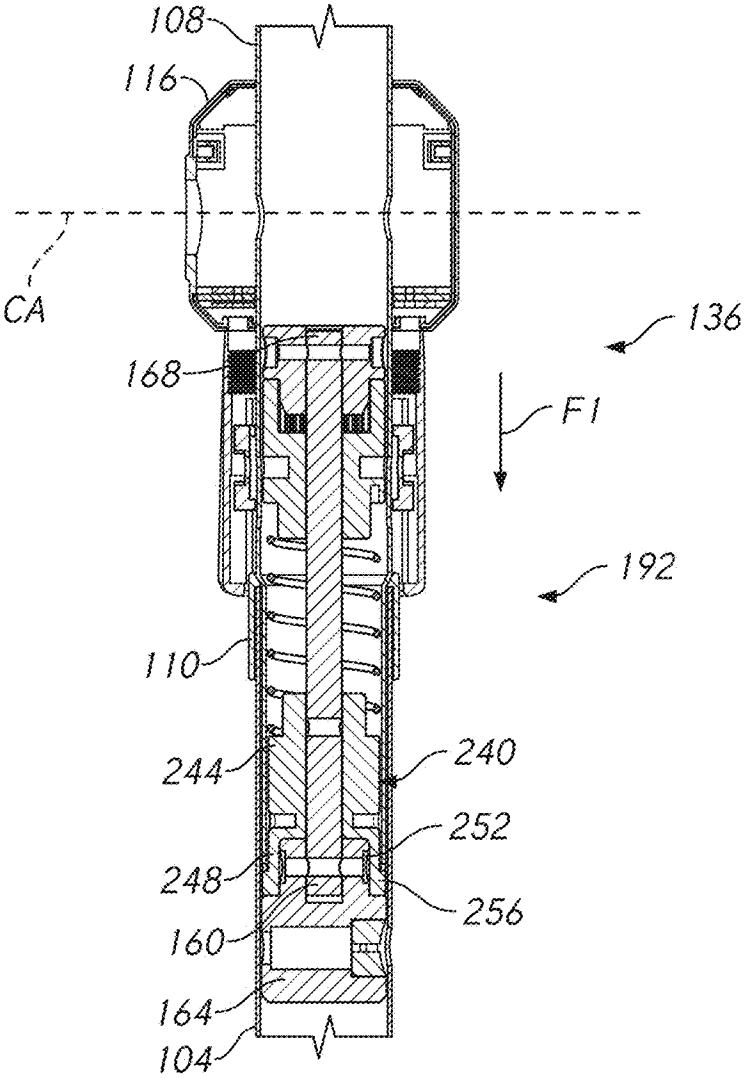
FIG. 4 is a vertical cross-section taken along the central longitudinal axis of a pole assembly of the umbrella including the rotation and locking assembly of FIG. 2.
Figure 7:
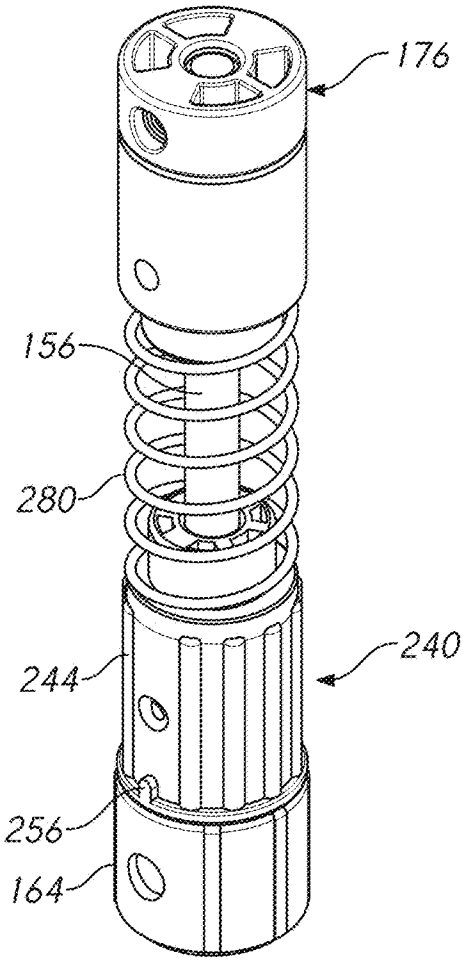
FIG. 7 is a perspective view of a portion of a rotation and locking assembly configured to be placed in a pole assembly of an improvement of the umbrella of FIG. 1.

FIGS. 4-5 show the rotation and locking assembly 136 in cross-section to better illustrate the assembly. The rotation and locking assembly 136 includes a plug member 164 that is used to hold a lower portion of the rotation and locking assembly 136 in a fixed position within the lower pole portion 104. The rotation and locking assembly 136 also includes a first locking member 176. FIG. 4 shows that the first locking member 176 is located within the lower portion of the central pole portion 108. The first locking member 176 is held in a fixed position at all times during the use of the rotation and locking assembly 136. In one embodiment a shaft 156 is provided that is coupled with the plug member 164 and that is also coupled with the first locking member 176. The shaft 156 can be secured to the plug member 164 by being connected by a pin, bolt or other fastener 252 that extends through a lower portion 160 of the shaft 156 and through a portion of the plug member 164. The plug member 164 can be fitted in the lower pole portion 104, e.g., press-fit, welded, or connected by rivets or other mechanical fasteners. The shaft 156 can have an upper portion 168 that extends through a central recess 182 of the first locking member 176 and that is secured to the first locking member 176 by a pin, bolt or other mechanical fastener that extends through the upper portion 168 and through a portion of the first locking member 176. The shaft 156 can have a length sufficient to extend to a location that corresponds to the position of the hand grip 194, or have a length that positions the first locking member 176 above or below the hand grip 194.

The first locking member 176 can be configured to releasably secure to a second locking member 185. The first locking member 176 can have a fixed clutch portion 180 that facilitates releasably securing to the second locking member 185. The first locking member 176 can have a plurality of external splines 183. The external splines 183 can be aligned with the central recess 182. The external splines 183 can be aligned with the shaft 156. The first locking member 176 can also have a tapered lower end 184. The tapered lower end 184 can be configured to facilitate the re-engagement of the second locking member 185 with the first locking member 176 to cause the rotation and locking assembly 136 to be placed in a locked of fixed configuration.

The second locking member 185 can comprise a moveable clutch portion 186. For example, the second locking member 185 can have a central passage 187 disposed therethrough. The central passage 187 allows the shaft 156 to be disposed through the second locking member 185. The central passage 187 can have a diameter larger than the outer diameter of the shaft 156. The second locking member 185 can have a top portion that includes an upper recess 188. The upper recess 188 can have an internal peripheral wall with a feature that can engage and disengage the external splines 183. For example, the upper recess 188 can have a plurality of internal splines 189 disposed on an inner surface thereof. The rotation and locking assembly 136 can have a first position 212 in which the internal splines 189 on the second locking member 185 and the external splines 183 on the first locking member 176 overlap along the longitudinal axis LA and are engaged.

As discussed above, the drive ring 200 can move along an outside surface of the central pole portion 108. A blind recess 190 formed in the second locking member 185 can be configured to receive a shaft 220 that is coupled with the drive ring 200. The movement of the drive ring 200 can cause movement of the shaft 220 and thereby movement of the second locking member 185. FIG. 5 shows that the second locking member 185 can be secured to the drive ring 200 by a plurality of shafts 220, e.g., one on each of opposing sides of the second locking member 185.

The longitudinal position of the second locking member 185 relative to the first locking member 176 is controlled in various embodiments. For example, the second locking member 185 can include a shoulder 191. The shoulder 191 can be used to couple with a first end of a spring 280. The spring 280 can have a second end coupled with an upper portion 244 of a thrust bearing 240. For example, the thrust bearing 240 can have a shoulder on the upper portion 244. When a downward force F1 is applied to the hand grip 194, the force is transferred through the drive ring 200 and the shaft 220 to the second locking member 185. As the second locking member 185 is moved downward in response to the downward force F1, the spring 280 is compressed, storing strain energy. When the hand grip 194 is released and the downward force F1 is no longer being applied, the stored strain energy is released as the second locking member 185 moves upwardly. The tapered lower end 184 helps guide the internal splines 189 into engagement with the external splines 183.

The thrust bearing 240 provide rotational movement of the rotation and locking assembly 136 as a torque is applied to the hand grip 194. The torque is transferred to the central pole portion 108 by way of the shafts 220 that extend through the drive ring 200 and into the second locking member 185. The pole assembly 100 includes a feature for engaging the central pole portion 108 with the thrust bearing 240. In one embodiment the central pole portion 108 has a notch 260 at the bottom end thereof. The notch 260 is advanced over a radial projection 256 of the thrust bearing 240. The radial projection 256 is located on a lower portion 248 of the thrust bearing 240. In assembly, the radial projection 256 can be advanced over the notch 260. Once the radial projection 256 is in the notch 260 rotation of the central pole portion 108 will apply a torque to the thrust bearing 240 through engagement of the notch 260 by the radial projection 256.

The use of the umbrella 10 improved by incorporation of the rotation and locking assembly 136 will now be described. Once the canopy assembly 14 is opened, the upper portion 30 can be tilted if desired. The rotational position of the canopy assembly 14 relative to lower portion 22 can then be adjusted. For example the central portion 26 or the central pole portion 108 can be rotated. The rotation and locking assembly 136 can be used to rotate these pole portions as follows. A hand can grip the hand grip 194. The hand can apply a downward force F1 to the hand grip 194. The downward force F1 can cause the hand grip 194 to move down along the longitudinal axis LA. Such movement can move the hand grip 194 from the first position 212 to the second position 216. The movement from the first position 212 to the second position 216 corresponds to moving the shaft 220 along the slot 204.

As the shaft 220 moves to the lower end of the slot 204 the second locking member 185 is disengaged from the first locking member 176. The internal splines 189 can be disengaged from the external splines 183. The internal splines 189 can be moved to a position below the external splines 183. In this position, a torques applied to the hand grip 194 rotates the hand grip 194 and the central pole portion 108 by applying the torque to the outer central pole portion 108 through the slot 204. The thrust bearing 240 is supported on the plug member 164 in a manner that enables the thrust bearing 240 to rotate on the plug member 164. Once the desired position is reached, the hand grip 194 can be released allowing the second locking member 185 to translate upward along the longitudinal axis LA of the pole assembly 100. The spring 280 causes a load to be applied to the second locking member 185 to shift the second locking member 185 and the hand grip 194 from the second position 216 to the first position 212. Once the internal splines 189 are engaged with the external splines 183 the rotation of the hand grip 194 is prevented.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An umbrella comprising:

a canopy;

a pole extending along a longitudinal axis and having an upper portion coupled with the canopy and a lower portion rotatably coupled with the upper portion; and a rotation and locking assembly configured to rotate the upper portion of the pole, the rotation and locking assembly comprising:

a shaft having a lower end fixed to the lower portion of the pole and an upper end disposed above the lower portion of the pole;

a first locking member disposed above the lower portion of the pole, coupled with the upper end of the shaft, and positioned within the upper portion of the pole;

a second locking member disposed above the lower portion of the pole adjacent to the first locking member, the second locking member positioned within the upper portion of the pole and configured to engage the first locking member; and a hand grip disposed around the upper portion of the pole and engaged with the second locking member, the hand grip having a first position along the longitudinal axis of the pole in which the second locking member is engaged with the first locking member and a second position along the longitudinal axis of the pole spaced apart from the first position in which the second locking member is disengaged from the first locking member.

2. The umbrella of claim 1, further comprising a drive ring disposed around a pole portion above the lower portion of the pole, the drive ring being moveable along the longitudinal axis of the pole by movement of the hand grip.

3. The umbrella of claim 1, wherein the first locking member comprises a central recess disposed around the upper end of the shaft and an outer surface comprising a plurality of splines disposed thereon.

4. The umbrella of claim 3, wherein the first locking member comprises a tapered lower end.

5. The umbrella of claim 1, wherein the second locking member comprises a central passage disposed around the shaft and an upper recess comprising a plurality of splines disposed on an inner surface thereof.

6. An umbrella comprising:

a canopy;

a pole extending along a longitudinal axis and having an upper portion coupled with the canopy and a lower portion rotatably coupled with the upper portion; and a rotation and locking assembly configured to rotate the upper portion of the pole, the rotation and locking assembly comprising:

a shaft having a lower end fixed to the lower portion of the pole and an upper end disposed above the lower portion of the pole;

a first locking member disposed above the lower portion of the pole and coupled with the upper end of the shaft;

a second locking member disposed above the lower portion of the pole adjacent to the first locking member, the second locking member configured to engage the first locking member;

a hand grip disposed around the upper portion of the pole and engaged with the second locking member, the hand grip having a first position along the longitudinal axis of the pole in which the second locking member is engaged with the first locking member and a second position along the longitudinal axis of the pole spaced apart from the first position in which the second locking member is disengaged from the first locking member; and a drive ring disposed around a pole portion above the lower portion of the pole the drive ring being moveable along the longitudinal axis of the pole by movement of the hand grip;

wherein the drive ring further comprises a plurality of splines aligned with the longitudinal axis of the pole.

7. The umbrella of claim 6 wherein the hand grip comprises an outer surface and an inner surface, a plurality of radial projections being disposed on the inner surface and being configured to engage the plurality of splines.

8. The umbrella of claim 7, wherein the pole comprises a slot and further comprising a shaft coupled with the hand grip, the shaft disposed through the drive ring and the slot of the pole, wherein an inner portion of the shaft is coupled with the second locking member.

9. An umbrella comprising:

a canopy;

a pole extending along a longitudinal axis and having an upper portion coupled with the canopy and a lower portion rotatably coupled with the upper portion; and a rotation and locking assembly configured to rotate the upper portion of the pole, the rotation and locking assembly comprising:

a shaft having a lower end fixed to the lower portion of the pole and an upper end disposed above the lower portion of the pole;

a first locking member disposed above the lower portion of the pole and coupled with the upper end of the shaft;

a second locking member disposed above the lower portion of the pole adjacent to the first locking member, the second locking member configured to engage the first locking member;

a hand grip disposed around the upper portion of the pole and engaged with the second locking member, the hand grip having a first position along the longitudinal axis of the pole in which the second locking member is engaged with the first locking member and a second position along the longitudinal axis of the pole spaced apart from the first position in which the second locking member is disengaged from the first locking member; and a thrust bearing having a first portion fixedly coupled with the lower portion of the pole and a second portion fixedly coupled with a lower end of a rotatable portion of the pole, the second portion rotatable relative to the first portion.

10. The umbrella of claim 9, wherein the second portion of the thrust bearing is partly inserted into the lower end of the rotatable portion of the pole and has a projection received in a recess of the lower end of the rotatable portion of the pole to transmit a torque between a rotatable portion of the upper portion of the pole and the second portion of the thrust bearing.

11. The umbrella of claim 10, further comprising a spring disposed between the second locking member and the thrust bearing, the spring configured to bias the hand grip to the first position.

12. An umbrella comprising:

a canopy;

a pole extending along a longitudinal axis and having a rotatable portion coupled with the canopy and a lower portion, the rotatable portion being rotatably coupled with the lower portion at a connection location where a lower end of the rotatable portion is disposed within and configured to rotate in an upper end of the lower portion;

a rotation assembly configured to rotate the rotatable portion of the pole, the rotation assembly comprising a hand grip and a drive ring, the drive ring having an inner surface surrounding the rotatable portion of the pole, the hand grip applying torque to the drive ring and thereby to the rotatable portion of the pole, wherein the hand grip rotates the drive ring in the same direction as the hand grip; and a locking assembly comprising a first locking member and a second locking member disengageable from the first locking member, the first locking member and the second locking member being disposed above the connection location, and wherein the first locking member is positioned within a lower portion of the rotatable portion of the pole.

13. The umbrella of claim 12, wherein the first locking member is disposed above the lower portion of the pole and is coupled with a shaft, the second locking member is disposed above the lower portion of the pole adjacent to the first locking member, the second locking member configured to engage the first locking member.

14. The umbrella of claim 12, wherein the hand grip is coupled with the second locking member to move the second locking member away from the first locking member to facilitate rotation of the rotatable portion of the pole.

15. An umbrella comprising:

a canopy;

a pole extending along a longitudinal axis and having a rotatable portion coupled with the canopy and a lower portion, the rotatable portion being rotatably coupled with the lower portion at a connection location where a lower end of the rotatable portion is disposed within and configured to rotate in an upper end of the lower portion;

a rotation assembly configured to rotate the rotatable portion of the pole, the rotation assembly comprising a hand grip and a drive ring disposed around the rotatable portion of the pole, the hand grip applying torque to the drive ring and thereby to the rotatable portion of the pole; and a locking assembly comprising a first locking member and a second locking member disengageable from the first locking member, the first locking member and the second locking member being disposed above the connection location;

wherein the first locking member is disposed above the lower portion of the pole and is coupled with a shaft, the second locking member is disposed above the lower portion of the pole adjacent to the first locking member, the second locking member configured to engage the first locking member, and wherein the shaft has a lower end fixed to the lower portion of the pole and an upper end disposed above the lower portion of the pole.

16. An umbrella comprising:

a canopy;

a pole extending along a longitudinal axis and having a rotatable portion coupled with the canopy and a lower portion to which the rotatable portion is rotatably coupled at a connection location; and a rotation assembly configured to rotate the rotatable portion of the pole, the rotation assembly comprising a hand grip having an inside surface disposed around an outside surface of the rotatable portion and around an inside surface of the rotatable portion disposed within the outside surface of the rotatable portion and a drive ring disposed around the outside surface of the rotatable portion of the pole, the hand grip transferring torque to the drive ring and thereby to the rotatable portion of the pole;

wherein the hand grip and the drive ring are configured to move along the longitudinal axis of the pole to disengage a locking assembly disposed within the inside surface of the rotatable portion of the pole to permit rotation of the rotatable portion of the pole relative to the lower portion of the pole.

17. The umbrella of claim 16, wherein the locking assembly comprising a first locking member and a second locking member disengageable from the first locking member, the first locking member and the second locking member being disposed within an inside surface of the rotatable portion of the pole above the connection location.

18. The umbrella of claim 17, wherein the hand grip is coupled with the second locking member to move the second locking member away from the first locking member to facilitate rotation of the rotatable portion of the pole.

19. An umbrella comprising:

a canopy;

a pole extending along a longitudinal axis and having a rotatable portion coupled with the canopy and a lower portion to which the rotatable portion is rotatably coupled at a connection location, wherein a lower end of the rotatable portion is disposed within an upper end of the lower portion; and a rotation assembly configured to rotate the rotatable portion of the pole, the rotation assembly comprising a hand grip and a drive ring disposed around the rotatable portion of the pole, the hand grip applying torque to the drive ring and thereby to the rotatable portion of the pole;

wherein the hand grip and the drive ring are configured to move along the longitudinal axis of the pole to disengage a locking assembly disposed within an inside surface of the rotatable portion of the pole to permit rotation of the rotatable portion of the pole relative to the lower portion of the pole, wherein the locking assembly comprising a first locking member and a second locking member disengageable from the first locking member, the first locking member and the second locking member being disposed within an inside surface of the rotatable portion of the pole above the connection location, wherein the first locking member is disposed above the lower portion of the pole and is coupled with a shaft, the second locking member is disposed above the lower portion of the pole adjacent to the first locking member, the second locking member configured to engage the first locking member.

20. The umbrella of claim 19, wherein the shaft has a lower end fixed to the lower portion of the pole and an upper end disposed above the lower portion of the pole.

* * * * *